US011607766B2

(12) United States Patent
Liu et al.

(10) Patent No.: US 11,607,766 B2
(45) Date of Patent: Mar. 21, 2023

(54) DEVICE FOR REMOVING WHEEL BURRS WITH BRUSHES

(71) Applicant: CITIC Dicastal CO., LTD., Hebei (CN)

(72) Inventors: Huiying Liu, Qinhuangdao (CN); Lijie Hu, Qinhuangdao (CN)

(73) Assignee: CITIC Dicastal CO., LTD., Qinhuangdao (CN)

( * ) Notice: Subject to any disclaimer, the term of this patent is extended or adjusted under 35 U.S.C. 154(b) by 929 days.

(21) Appl. No.: 16/503,535

(22) Filed: Jul. 4, 2019

(65) Prior Publication Data

US 2020/0147740 A1 May 14, 2020

(30) Foreign Application Priority Data

Nov. 12, 2018 (CN) ..... 201811338880.8

(51) Int. Cl.
*B24B 9/04* (2006.01)
*B24B 29/04* (2006.01)
(Continued)

(52) U.S. Cl.
CPC ..... *B24B 5/44* (2013.01); *B24B 9/04* (2013.01); *B24B 27/0023* (2013.01);
(Continued)

(58) Field of Classification Search
CPC ... B24B 27/0076; B24B 41/00; B24B 41/005; B24B 41/02; B24B 41/06; B24B 5/12;
(Continued)

(56) References Cited

U.S. PATENT DOCUMENTS 3,258,804 A * 7/1966 Fowle ..... B24B 9/005 15/104.04
4,216,560 A * 8/1980 Schmidt ..... B24B 41/06 451/406
(Continued)

FOREIGN PATENT DOCUMENTS

CN 203438027 U * 2/2014
CN 105945668 A 9/2016
(Continued)

OTHER PUBLICATIONS

Supplementary European Search Report in the European application No. 19205989.7, dated Mar. 31, 2020.

*Primary Examiner* — Eileen P Morgan
(74) *Attorney, Agent, or Firm* — Syncoda LLC; Feng Ma

(57) ABSTRACT

A device for removing wheel burrs with first brushes and second brushes includes a wheel positioning and pressing system configured to position and press of the wheel, a center cap mouth burr removing system configured to remove burrs of the wheel cap mouth with the second brushes, and a wheel spoke back cavity burr removing system configured to remove burrs of the wheel spoke back cavity with the first brushes. The first brushes are mounted on an expandable first capsule and the second brushes are mounted on an expandable second conical capsule, and filling the expandable first capsule and the expandable second conical capsule with air and removing air from the expandable first capsule and the expandable second conical capsule change the shapes of the first brushes and the second brushes to accommodate wheels with different shape and size for deburring.

1 Claim, 3 Drawing Sheets

(51) Int. Cl.

| | |
|---|---|
| ***B24B 5/44*** | (2006.01) |
| ***B24B 41/06*** | (2012.01) |
| ***B24B 29/00*** | (2006.01) |
| ***B24B 27/00*** | (2006.01) |

(52) U.S. Cl.
CPC ..... *B24B 27/0076* (2013.01); *B24B 29/005* (2013.01); *B24B 29/04* (2013.01); *B24B 41/06* (2013.01)

(58) Field of Classification Search
CPC .. B24B 5/44; B24B 9/04; B24B 19/00; B24B 29/005; B24B 29/04
USPC ..... 451/178, 190
See application file for complete search history.

(56) References Cited

U.S. PATENT DOCUMENTS

| | | | | |
|---|---|---|---|---|
| 2013/0102233 | A1* | 4/2013 | Cheon ..... | B24B 27/033 451/331 |
| 2018/0001436 | A1 | 1/2018 | Xue et al. | |

FOREIGN PATENT DOCUMENTS

| | | | | |
|---|---|---|---|---|
| CN | 109262399 | A * | 1/2019 | ..... B24B 27/0076 |
| JP | 3044289 | B2 * | 5/2000 | |
| JP | 3091417 | B2 * | 9/2000 | |

* cited by examiner

DEVICE FOR REMOVING WHEEL BURRS WITH BRUSHES

CROSS-REFERENCE TO RELATED APPLICATIONS

The present application claims priority to Chinese Application No. 201811338880.8 filed on Nov. 12, 2018, the disclosure of which is hereby incorporated by reference in its entirety.

BACKGROUND

Burrs of a wheel need to be removed after machining, currently, the burrs are usually removed by using a deburring machine, but the wheel types are various, the wheel spoke back cavity shapes are complex and different, thus it is unable to realize generality of brushes, and the burr brush often needs to be replaced according to the wheel model, which not only is low in efficiency, but also needs to invest a lot of costs for manufacturing a lot of brushes with different specifications. Based on the present situation, the present disclosure provides a device for removing wheel burrs with brushes. This device not only can be used for continuous automation production, but also can correspondingly adjust the shape of the burr brush according to the wheel model, so that the shape of the burr brush is consistent with the shape of the wheel spoke back cavity and the shape of the center cap mouth, which does not need to manufacture large quantities of different specifications of brushes, thus saving the manufacture cost. The device has high universality and application value.

SUMMARY

The present disclosure relates to the technical field of wheel burrs removal, in particular, to a device for removing burrs of a wheel center hole, a wheel cap mouth and a wheel spoke back cavity with first brushes and second brushes.

The objective of the present disclosure is to provide a device for removing wheel burrs with first brushes and second brushes, which can be used for continuous automation production, and also can correspondingly adjust the shapes of the first brushes and the second brushes according to the wheel model, so that the shapes of the first brushes are consistent with the shape of the wheel spoke back cavity and the shapes of the second brushes are consistent with the shape of the center cap mouth, and the device has high universality and application value.

In order to achieve the above objective, the technical solution of the present disclosure is that, a device for removing wheel burrs with first brushes and second brushes is composed of a main frame, a secondary frame, a supporting plate, a first cylinder, a first guide sleeve, a first guide post, a lifting platform, a first servo motor, a bearing seat, a shaft, a bearing, first air compressors, a rotating plate, second sleeves, a first capsule, a supporting platform, a positioning plate, a first guide rail, a first slider, second cylinders, a third cylinder, an upper a second guide post, a pressing plate, a third pressing sleeve, a second servo motor, a coupling, a rotary table, a guide column, a fourth adjusting cylinder, a second air compressor, a feed platform a second conical capsule, a second slider, a second guide rail.

The device for removing wheel burrs with first brushes and second brushes is composed of three systems: a wheel positioning and pressing system, configured to finish the positioning and pressing of the wheel; a center cap mouth burr removing system, configured to finish the removal of burrs of the wheel cap mouth and the wheel center hole with the second brushes; and a wheel spoke back cavity burr removing system, configured to finish the removal of burrs of the wheel spoke back cavity with the first brushes. The three systems complement each other and work closely together to remove the wheel burrs.

The circular positioning plate is mounted on the secondary frame, the positioning plate has a hollow structure, and the inner wall is provided with a stepped circular ring. The diameter of the circular ring matches the outer diameter of the inner rim of the wheel, preferably 15-20 inches, which can satisfy the positioning of a common wheel. The third cylinder is located above the main frame, the third cylinder controls the up and down movement of the pressing plate under the guiding action of the second guide post, and the third pressing sleeve is elastic and mounted on the top of the pressing plate. After a mechanical arm places the wheel on the positioning plate, the third cylinder is operated to drive the third pressing sleeve to move downwardly, and the third pressing sleeve and the front of the outer rim of the wheel are in contact with each other to press the wheel. This is the wheel positioning and pressing system, which can finish the positioning and pressing of the wheel.

The second servo motor is mounted at the center of the pressing plate, and the output end of the second servo motor is connected to the rotary table to control the rotation of the rotary table. The fourth adjusting cylinder is mounted under the rotary table and controls the up and down movement of the feed platform under the guiding action of the guide column. The second air compressor is fixed at the center of the feed platform, and the output end of the second air compressor is connected with the second conical capsule. The second conical capsule is made of a plastic material, can be expanded and become large after being filled with compressed air, and can be restored to its original state after the compressed air is removed. The second brushes are evenly distributed in the outer surface of the second conical capsule. When the wheel is positioned and clamped, the fourth adjusting cylinder is operated to drive the second conical capsule to move downwardly to a suitable height, and then the second air compressor is operated to fill the second conical capsule with compressed air. Under the action of the pressure, the second conical capsule is expanded and becomes larger, and the second brushes on the outer surface of the second conical capsule can contact the inner wall of the wheel center cap mouth and fit the inner wall evenly and tightly. Finally, the second servo motor is operated to drive the second conical capsule to rotate, thereby removing burrs in the wheel center cap mouth. This is the center cap mouth burr removing system, which can finish the removal of burrs of the wheel cap mouth and the wheel center hole.

The first cylinder is located below the main frame and controls the up and down movement of the lifting platform under the guiding action of the first guide post. The first servo motor is installed at the center of the lifting platform, the output end of the first servo motor is connected to the circular rotating plate, the rotating plate is symmetrically provided with the first air compressors on two sides of the rotating plate, and the output ends of the first air compressors are connected with the second sleeves; the first brushes are evenly distributed on the surface of the first capsule, one end of the first capsule is connected to the second sleeves, and the other end is connected to the first slider and the second slider; the first slider is mounted on the first guide rail, and the second slider is mounted on the second guide rail. The positions of the first slider and the second slider can be respectively adjusted by the second cylinders, thereby adjusting the initial width of the first capsule, so as to match different wheel back cavity widths. When the wheel is positioned and clamped, the center cap mouth burr removing system is operated, at the same time, the wheel spoke back cavity burr removing system also is operated. Firstly, the first cylinder is operated to drive the rotating plate to move upwardly to a suitable height, and then the first air compressors are operated to fill the first capsule with compressed air. Under the action of the pressure, the first capsule is expanded and becomes larger, and can adaptively deform according to the shape of the wheel spoke back cavity. The first brushes on the surface of the first capsule can contact the wheel spoke back cavity and fit the wheel spoke back cavity evenly and tightly, so as to achieve consistency between the shapes of the first brushes and the shape of the back cavity. Finally, the first servo motor is operated to drive the rotating plate to rotate, thereby driving the first brushes to rotate, so as to remove the burr from the wheel spoke back cavity. This is the wheel spoke back cavity burr removing system, which can finish the removal of burrs of the wheel spoke back cavity.

A working process for a device for removing wheel burrs with first brushes and second brushes is that: firstly, the mechanical arm places the wheel on the positioning plate, the third cylinder is operated to drive the third pressing sleeve to move downwardly, and the third pressing sleeve and the front of the outer rim of the wheel are in contact with each other to press the wheel. When the wheel is positioned and clamped, the fourth adjusting cylinder is operated to drive the second conical capsule to move downwardly to a suitable height, and then the second air compressor is operated to fill the second conical capsule with compressed air. Under the action of the pressure, the second conical capsule is expanded and becomes larger, and the second brushes on the outer surface of the second conical capsule can contact the inner wall of the wheel center cap mouth and fit the inner wall evenly and tightly. Then, the second servo motor is operated to drive the second conical capsule to rotate, thereby removing burrs in the wheel center cap mouth. The positions of the first slider and the second slider are adjusted by the second cylinders so that the initial width of the first capsule can match the width of the wheel back cavity. The center cap mouth burr removing system is operated, at the same time, the wheel spoke back cavity burr removing system also is operated. Firstly, the first cylinder is operated to drive the rotating plate to move upwardly to a suitable height, and then the first air compressors are operated to fill the first capsule with compressed air. Under the action of the pressure, the first capsule is expanded and becomes larger, and can adaptively deform according to the shape of the wheel spoke back cavity. The first brushes on the surface of the first capsule can contact the wheel spoke back cavity and fit the wheel spoke back cavity evenly and tightly, so as to achieve consistency between the shapes of the first brushes and the shape of the wheel spoke back cavity. Finally, the first servo motor is operated to drive the rotating plate to rotate, thereby driving the first brushes to rotate, so as to remove the burrs from the wheel spoke back cavity. After the burrs are removed, the various systems are restored to their original states, and the mechanical arm takes the deburred wheels and then loads the next to-be-deburred wheel, and operations are repeated in this way.

The device not only can be used for continuous automation production, but also can correspondingly adjust the shape of the first brushes and the second brushes according to the wheel model, so that the shapes of the first brushes are consistent with the shape of wheel spoke back cavity and the shapes of the second brushes are consistent with the shape of the center cap mouth, which does not need to manufacture large quantities of different specifications of brushes, thus saving the manufacture cost. The device has high universality and application value.

DETAILED DESCRIPTION

The following describes details and operation of a specific device provided by the present disclosure with reference to the accompanying drawings.

Figure 1:
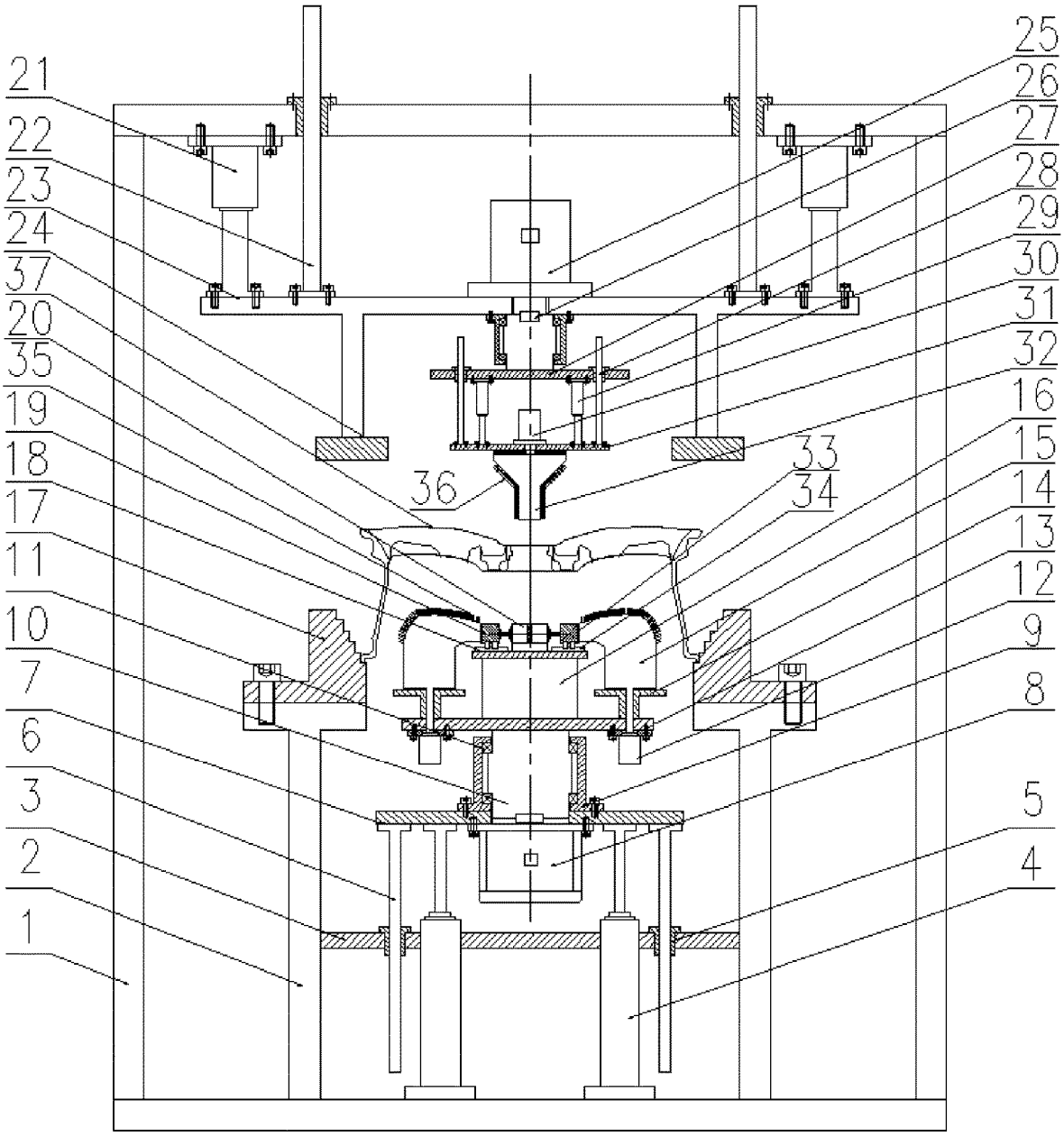
FIG. 1 is a front view of a device for removing wheel burrs with first brushes and second brushes of the present disclosure.
Figure 2:
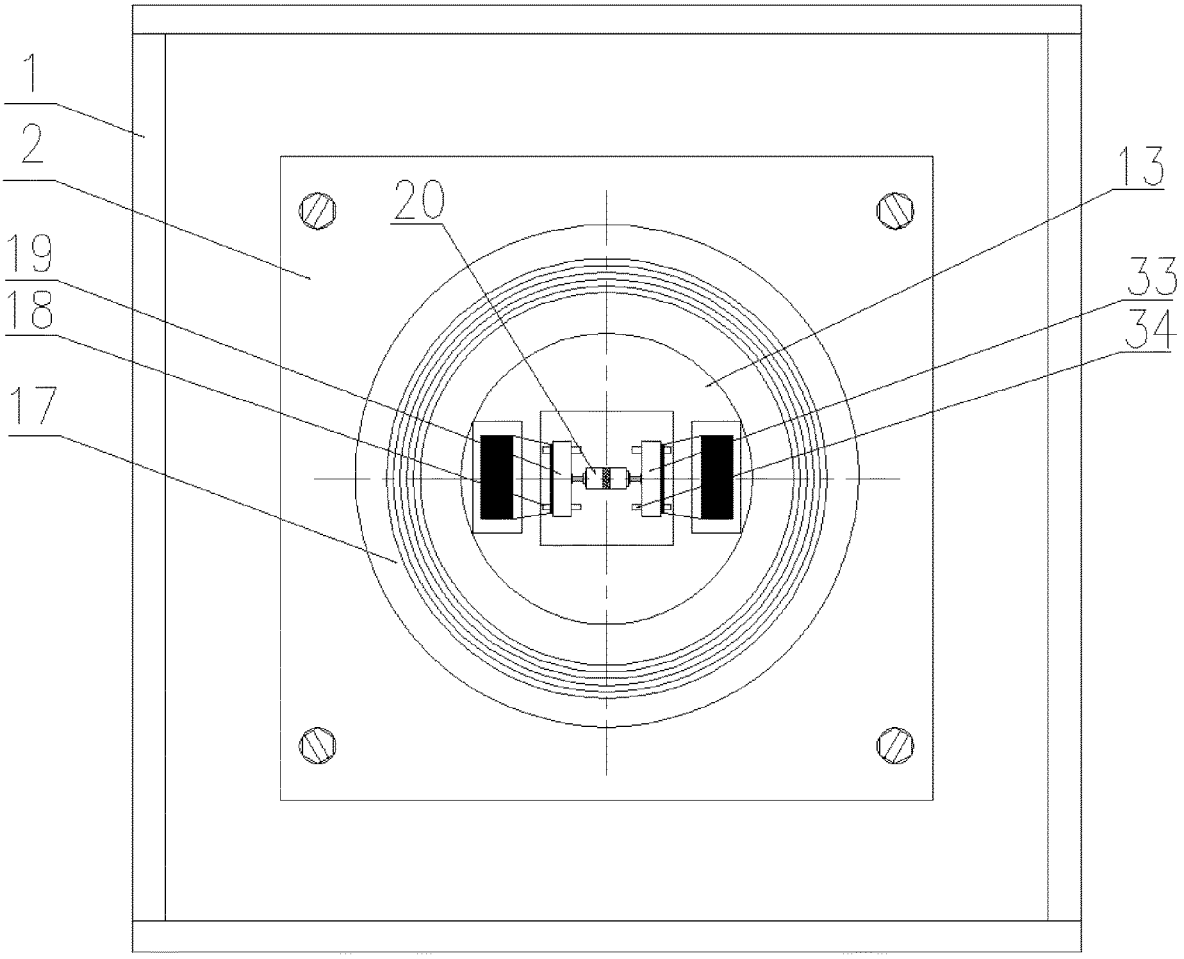
FIG. 2 is a top view of a device for removing wheel burrs with first brushes and second brushes of the present disclosure.
Figure 3:
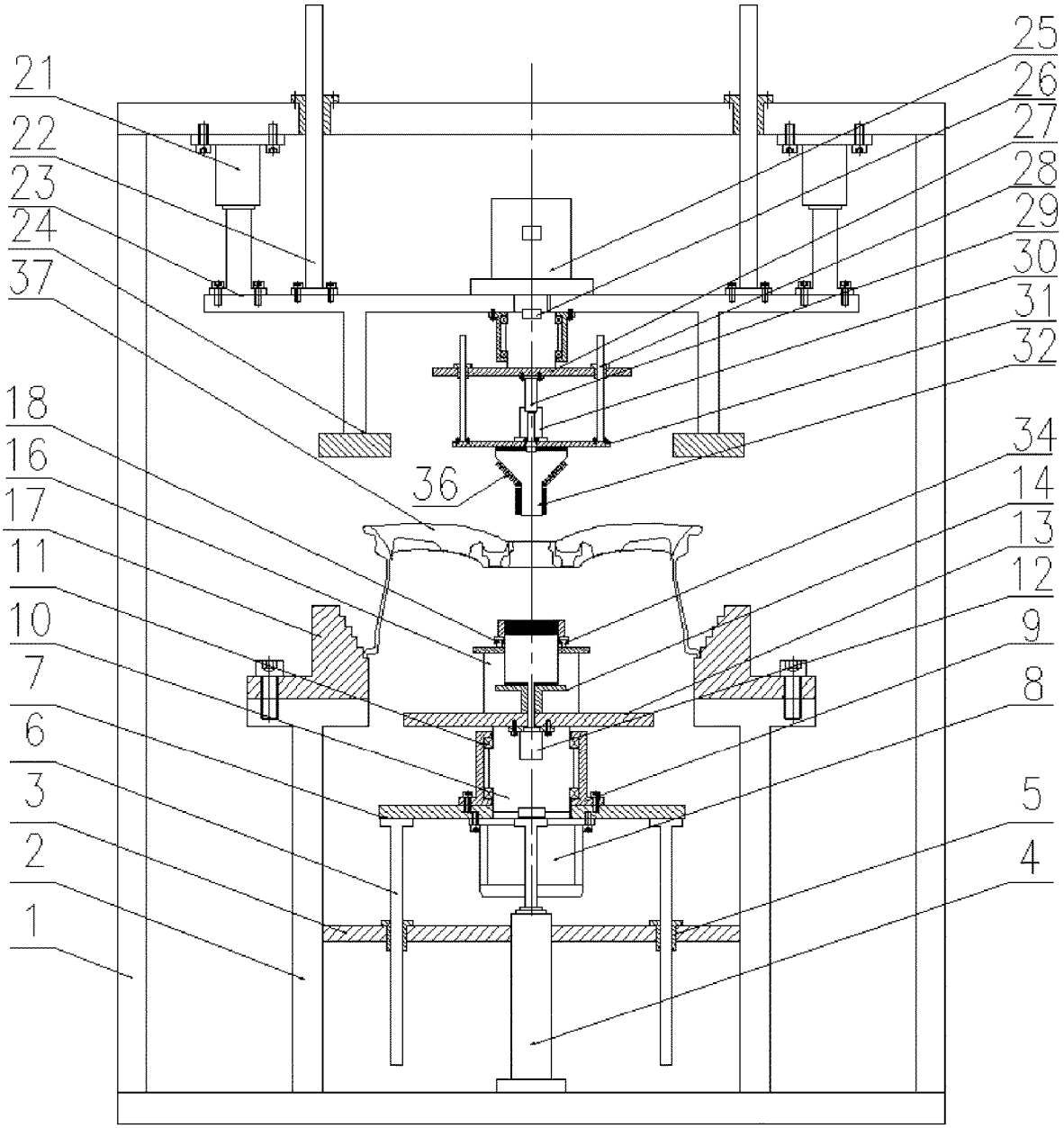
FIG. 3 is a side view of a device for removing wheel burrs with first brushes and second brushes of the present disclosure.

A device for removing wheel burrs with first brushes and second brushes, as illustrated in FIG. 1, FIG. 2, and FIG. 3, can comprise a main frame 1, a secondary frame 2, a supporting plate 3, a first cylinder 4, a first guide sleeve 5, a first guide post 6, a lifting platform 7, a first servo motor 8, a bearing seat 9, a shaft 10, a bearing 11, first air compressors 12, a rotating plate 13, first and second sleeves 14, a first capsule 15, a supporting platform 16, a positioning plate 17, a first guide rail 18, a first slider 19, second cylinders 20, a third cylinder 21, a second guide post 22, a pressing plate 23, a third pressing sleeve 24, a second servo motor 25, a coupling 26, a rotary table 27, a guide column 28, a fourth adjusting cylinder 29, a second air compressor 30, a feed platform 31, a second conical capsule 32, a second slider 33, a second guide rail 34, first brushes 35, and second brushes 36.

The device for removing wheel burrs with first brushes and second brushes is composed of three systems: a wheel positioning and pressing system, configured to finish the positioning and pressing of the wheel 37; a center cap mouth burr removing system, configured to finish the removal of burrs of the wheel cap mouth and the wheel center hole with second brushes; and a wheel spoke back cavity burr removing system, configured to finish the removal of burrs of the wheel spoke back cavity with first brushes. The three systems complement each other and work closely together to remove the wheel burrs.

The circular positioning plate 17 is mounted on the secondary frame 2, the positioning plate 17 has a hollow structure, and the inner wall is provided with a stepped circular ring. The diameter of the circular ring matches the outer diameter of the inner rim of the wheel, preferably 15-20 inches, which can satisfy the positioning of a common wheel. The third cylinder 21 is located above the main frame 1, the third cylinder 21 controls the up and down movement of the pressing plate 23 under the guiding action of the second guide post 22, and the third pressing sleeve 24 is elastic and mounted on the top of the pressing plate 23. After a mechanical arm places the wheel 37 on the positioning plate 17, the third cylinder 21 is operated to drive the third pressing sleeve 24 to move downwardly, and the third pressing sleeve 24 and the front of the outer rim of the wheel 37 are in contact with each other to press the wheel 37. This is the wheel positioning and pressing system, which can finish the positioning and pressing of the wheel 37.

The second servo motor 25 is mounted at the center of the pressing plate 23, and the output end of the second servo motor 25 is connected to the rotary table 27 to control the rotation of the rotary table 27. The fourth adjusting cylinder 29 is mounted under the rotary table 27 and controls the up and down movement of the feed platform 31 under the guiding action of the guide column 28. The second air compressor 30 is fixed at the center of the feed platform 31, and the output end of the second air compressor is connected with the second conical capsule 32. The second conical capsule 32 is made of a plastic material, can be expanded and become large after being filled with compressed air, and can be restored to its original state after the compressed air is removed. The second brushes 36 are evenly distributed in the on the outer surface of the second conical capsule 32. When the wheel is positioned and clamped, the fourth adjusting cylinder 29 is operated to drive the second conical capsule 32 to move downwardly to a suitable height, and then the second air compressor 30 is operated to fill the second conical capsule 32 with compressed air. Under the action of the pressure, the second conical capsule 32 is expanded and becomes larger, and the second brushes 36 on the outer surface of the second conical capsule 32 can contact the inner wall of the wheel center cap mouth and fit the inner wall evenly and tightly. Finally, the second servo motor 25 is operated to drive the second conical capsule 32 to rotate, thereby removing burrs in the wheel center cap mouth. This is the center cap mouth burr removing system, which can finish the removal of burrs of the wheel cap mouth and the wheel center hole.

The first cylinder 4 is located below the main frame 1 and controls the up and down movement of the lifting platform 7 under the guiding action of the first guide post 6. The first servo motor 8 is installed at the center of the lifting platform 7, the output end of the first servo motor 8 is connected to the circular rotating plate 13, the rotating plate 13 is symmetrically provided with the first air compressors 12 on two sides of the rotating plate 13, and the output ends of the first air compressors are connected with the second sleeves 14; first brushes 35 are evenly distributed on the surface of the first capsule 15, one end of the first capsule 15 is connected to the second sleeves 14, and the other end is connected to the first slider 19 and the second slider 33; the first slider 19 is mounted on the first guide rail 18, and the second slider 33 is mounted on the second guide rail 34. The positions of the first slider 19 and the second slider 33 can be respectively adjusted by the second cylinders 20, thereby adjusting the initial width of the first capsule 15, so as to match different wheel back cavity widths. When the wheel is positioned and clamped, the center cap mouth burr removing system is operated, at the same time, the wheel spoke back cavity burr removing system also is operated. Firstly, the first cylinder 4 is operated to drive the rotating plate 13 to move upwardly to a suitable height, and then the first air compressors 12 are operated to fill the first capsule 15 with compressed air. Under the action of the pressure, the first capsule 15 is expanded and becomes larger, and can adaptively deform according to the shape of the wheel spoke back cavity. The first brushes 35 on the surface of the first capsule 15 can contact the wheel spoke back cavity and fit the wheel spoke back cavity evenly and tightly, so as to achieve consistency between the first brushes 35 and the shape of the back cavity. Finally, the first servo motor 8 is operated to drive the rotating plate 13 to rotate, thereby driving the first brushes 35 to rotate, so as to remove the burr from the wheel spoke back cavity. This is the wheel spoke back cavity burr removing system, which can finish the removal of burrs of the wheel spoke back cavity.

A working process for a device for removing wheel burrs with the first brushes 35 and the second brushes 36 is that: firstly, the mechanical arm places the wheel on the positioning plate 17, the third cylinder 21 is operated to drive the third pressing sleeve 24 to move downwardly, and the third pressing sleeve 24 and the front of the outer rim of the wheel are in contact with each other to press the wheel. When the wheel is positioned and clamped, the fourth adjusting cylinder 29 is operated to drive the second conical capsule 32 to move downwardly to a suitable height, and then the second air compressor 30 is operated to fill the second conical capsule 32 with compressed air. Under the action of the pressure, the second conical capsule 32 is expanded and becomes larger, and the second brushes 36 on the surface of the second conical capsule 32 can contact the inner wall of the wheel center cap mouth and fit the inner wall evenly and tightly. Then, the second servo motor 25 is operated to drive the second conical capsule 32 to rotate, thereby removing burrs in the wheel center cap mouth. The positions of the first slider 19 and the second slider 33 are adjusted by the second cylinders 20 so that the initial width of the first capsule 15 can match the width of the wheel back cavity. The center cap mouth burr removing system is operated, at the same time, the wheel spoke back cavity burr removing system also is operated. Firstly, the first cylinder 4 is operated to drive the rotating plate 13 to move upwardly to a suitable height, and then the first air compressors 12 are operated to fill the first capsule 15 with compressed air. Under the action of the pressure, the first capsule 15 is expanded and becomes larger, and can adaptively deform according to the shape of the wheel spoke back cavity. The first brushes 35 on the surface of the first capsule 15 can contact the wheel spoke back cavity and fit the wheel spoke back cavity evenly and tightly, so as to achieve consistency between the burr brushes and the shape of the wheel spoke back cavity. Finally, the first servo motor 8 is operated to drive the rotating plate 13 to rotate, thereby driving the first brushes 35 to rotate, so as to remove the burrs from the wheel spoke back cavity. After the burrs are removed, the various systems are restored to their original states, and the mechanical arm takes the deburred wheels and then loads the next to-be-deburred wheel, and operations are repeated in this way.

The device not only can be used for continuous automation production, but also can correspondingly adjust the shape of the first brushes and the second brushes according to the wheel model, so that the shapes of the the first brushes are consistent with the shape of wheel spoke back cavity and the shapes of the second brushes are consistent with the shape of the center cap mouth, which does not need to manufacture large quantities of different specifications of brushes, thus saving the manufacture cost. The device has high universality and application value.

The invention claimed is:

1. A device for removing burrs of a wheel with first brushes and second brushes, comprising a main frame, a secondary frame, a first cylinder, a first guide post, a lifting platform, a first servo motor, a first air compressors, a rotating plate, first and second sleeves, a first capsule, a positioning plate, a first guide rail, a first slider, second cylinders, a third cylinder, a second guide post, a pressing plate, a third pressing sleeve, a second servo motor, a rotary table, a guide column, a fourth adjusting cylinder, a second air compressor, a feed platform, a second conical capsule, a second slider, a second guide rail;

wherein the positioning plate is mounted on the secondary frame, the positioning plate has a hollow structure, and an inner wall of the positioning plate is provided with a stepped circular ring, a diameter of the circular ring matches an outer diameter of an inner rim of the wheel; the third cylinder is located above the main frame, the third cylinder controls an up and down movement of the pressing plate under a guiding action of the second guide post, and the third pressing sleeve is elastic and mounted on a top of the pressing plate; after a mechanical arm places the wheel on the positioning plate, the third cylinder is operated to drive the third pressing sleeve to move downwardly, and the third pressing sleeve and a front of an outer rim of the wheel are in contact with each other to position and press the wheel;

wherein the second servo motor is mounted at a center of the pressing plate, and an output end of the second servo motor is connected to the rotary table to control a rotation of the rotary table, the fourth adjusting cylinder is mounted under the rotary table and controls an up and down movement of the feed platform under a guiding action of the guide column; the second air compressor is fixed at a center of the feed platform, and an output end of the second air compressor is connected with the second conical capsule; the second conical capsule is made of a plastic material, can be expanded and become large after being filled with compressed air, and can be restored to its original state after the compressed air is removed; the second brushes are evenly distributed on an outer surface of the second conical capsule; when the wheel is positioned and clamped, the fourth adjusting cylinder is operated to drive the second conical capsule to move downwardly to a suitable height, and then the second air compressor is operated to fill the second conical capsule with compressed air; under an action of a pressure, the second conical capsule is expanded and becomes larger, and the second brushes on the outer surface of the second conical capsule can contact an inner wall of a center cap mouth of the wheel and fit the inner wall of the center cap mouth evenly and tightly; finally, the second servo motor is operated to drive the second conical capsule to rotate, thereby removing burrs in the center cap mouth, wherein the first cylinder is located below the main frame and controls an up and down movement of the lifting platform under a guiding action of the first guide post the first servo motor is installed at a center of the lifting platform, an output end of the first servo motor is connected to the rotating plate, the rotating plate is symmetrically provided with the first air compressors on two sides of the rotating plate, and output ends of the first air compressors are connected with the first and second sleeves; the first brushes are evenly distributed on a surface of the first capsule, one end of the first capsule is connected to the first and second sleeves, and the other end is connected to the first slider and the second slider; the first slider is mounted on the first guide rail, and the second slider is mounted on the second guide rail; positions of the first slider and the second slider can be respectively adjusted by the second cylinders, thereby adjusting an initial width of the first capsule, so as to match different wheel back cavity widths; when the wheel is positioned and clamped, a center cap mouth burr removing system is operated, at the same time, a wheel spoke back cavity burr removing system also is operated; firstly, the first cylinder is operated to drive the rotating plate to move upwardly to a suitable height, and then the first air compressors are operated to fill the first capsule with compressed air; under an action of a pressure, the first capsule is expanded and becomes larger, and can adaptively deform according to a shape of a wheel spoke back cavity; the first brushes on the surface of the first capsule can contact the wheel spoke back cavity and fit the wheel spoke back cavity evenly and tightly, so as to achieve consistency between the first brushes and the shape of the wheel spoke back cavity;

finally, the first servo motor is operated to drive the rotating plate to rotate, thereby driving the first brushes to rotate, so as to remove the burrs from the wheel spoke back cavity.

* * * * *